US006089302A

United States Patent [19]

Britt

[11] Patent Number: 6,089,302

[45] Date of Patent: Jul. 18, 2000

[54] EXTENSIBLE DOORWAY BARRIER

[76] Inventor: Merrie Britt, c/o Andrew Freedman, Esq. 529 Central Ave., Scarsdale, N.Y. 10583

[ * ] Notice: Under 35 U.S.C. 154(b), the term of this patent shall be extended for 747 days.

[21] Appl. No.: 08/688,825

[22] Filed: Jul. 31, 1996

Related U.S. Application Data

[63] Continuation of application No. 08/354,718, Dec. 6, 1994, abandoned.

[51] Int. Cl.[7] ..... A47G 1/00

[52] U.S. Cl. ..... 160/98; 160/28

[58] Field of Search ..... 160/28, 27, 100, 160/92, 99, 96, 97, 98, 102

[56] References Cited

U.S. PATENT DOCUMENTS

| | | | |
|---|---|---|---|
| 337,192 | 3/1886 | Peck . | |
| 671,414 | 4/1901 | Pyle | 160/100 |
| 834,145 | 10/1906 | Landsberg . | |
| 1,111,087 | 9/1914 | Olson | 160/28 |
| 1,204,833 | 11/1916 | Warfel | 160/97 |
| 1,716,060 | 6/1929 | Hutchinson | 160/98 X |
| 1,823,290 | 9/1931 | Prawalsky . | |
| 1,857,911 | 5/1932 | Johnson | 160/28 X |
| 2,207,856 | 7/1940 | Gieser | 160/28 |
| 2,270,202 | 1/1942 | Persson | 160/102 X |
| 2,311,413 | 2/1943 | Persson | 160/28 |
| 2,379,120 | 6/1945 | Turner | 160/27 |
| 2,455,112 | 11/1948 | Christison | 160/32 |
| 3,000,063 | 9/1961 | Hoog . | |
| 3,378,950 | 4/1968 | Butler . | |
| 3,911,990 | 10/1975 | Hoover et al. | 160/100 |
| 4,103,458 | 8/1978 | Booker | 160/97 X |
| 4,492,263 | 1/1985 | Gebhard . | |
| 4,651,797 | 3/1987 | Lange | 160/28 X |
| 4,653,566 | 3/1987 | Miale . | |
| 4,787,174 | 11/1988 | Brown . | |

*Primary Examiner*—David M. Purol

*Attorney, Agent, or Firm*—Greenberg Traurig; Mark A. Wurm

[57] ABSTRACT

A safety gate attached to a door and its associated jamb, for preventing passage through the doorway of children, pets, or the like. The gate comprises a net attached to the door and to the jamb. At the jamb, the net is attached to a spring loaded return mechanism which also serves as a take-up reel. This return mechanism is firmly anchored to the jamb. The net is removably attached to the door, so that intended passage through the doorway may proceed. The net has a loop which is slipped over a hook fastened to the door. A flexible net deploys instantly, since it constantly spans the jamb and the edge of the door. It retracts by closing the door, requiring no separate effort or manipulation for closing. The net is stored compactly on the reel when not being used. The net is easily removed from the hook by adults, but far less so by small children. The flexible nature of the net discourages climbing because it yields under weight, as contrasted to prior art barriers having, for example, rigid, telescoping barriers. It also eliminates sharp edges, protrusions, and like structure which could snag, injure, and attract the attention of children and adults.

16 Claims, 2 Drawing Sheets

EXTENSIBLE DOORWAY BARRIER

This application is a Continuation of Ser. No. 08/354,718, filed Dec. 6, 1994, now abandoned.

BACKGROUND OF THE INVENTION

1. Field of the Invention

The present invention relates to a barrier fastened to and between a swinging door and its jamb. The barrier comprises a net which is paid out when the door opens, and retracts when the door is closed. The barrier also includes a spring loaded mechanical return device fastened to the door jamb.

2. Description of the Prior Art

The problem of children and pets escaping through a doorway when the door is opened has long vexed householders. As it would not be feasible to maintain the door closed, the prior art has suggested barriers which expand or extend to accommodate the progressively increasing gap between the door and its jamb as the door opens. Illustrative barriers are shown in U.S. Pat. No. 3,000,063, issued to L. J. Hoog on Sep. 19, 1961, U.S. Pat. No. 3,378,950, issued to A. A. Butler on Apr. 23, 1968, U.S. Pat. No. 4,492,263, issued to A. W. Gebhard on Jan. 8, 1985, U.S. Pat. No. 4,653,566, issued to M. R. Miale on Mar. 31, 1987, and U.S. Pat. No. 4,787,174, issued to T. Brown on Nov. 29, 1988.

Gebhard provides two axially expansible tubes for securing opposing ends of a net to the door jamb. The remaining inventions include complicated, cumbersome, and possibly unsightly rigid walls and box-like housings for reinforcing, guiding, and enclosing the expansible barrier.

A window shade having a mechanical return feature provides a compact arrangement for paying out and retracting a flexible planar member. Examples are seen in U.S. Pat. No. 337,192, issued to T. S. Peck on Mar. 2, 1886, U.S. Pat. No. 834,145, issued to T. Landsberg on Oct. 23, 1906, and U.S. Pat. No. 1,823,290, issued to F. P. Prawalsky on Sep. 15, 1931.

Peck shows a plain cylindrical storage and retraction apparatus. However, this invention alone would not suit the particular function and requirements of the present invention, as will be further discussed later. The devices of Landsberg and Prawalsky illustrate the opposite tendency, providing more structure than is preferred and necessary.

None of the above inventions and patents, taken either singly or in combination, is seen to describe the instant invention as claimed.

SUMMARY OF THE INVENTION

The present invention provides an extensible, self-retracting barrier of uncomplicated construction. Unlike telescoping or otherwise expansible rigid members, the flexible barrier is stored by winding on a reel. It pays out rapidly when deployed, and has sufficient strength to accomplish its primary purpose, which is to deter passage of children and pets through the doorway.

The novel apparatus is of unparalleled compactness and unobtrusiveness as a doorway barrier. When stored, the apparatus occupies the volume of a slender cylinder. A very short portion of the barrier extends to the door to which it is attached. Attachment to the door is by engagement of a small loop formed on the barrier with small hooks secured to the door. The visual impression of the resultant barrier is of minimal size.

When the door is opened, the barrier pays out. Apart from the exposed barrier, the deployed apparatus does not occupy appreciably more space, nor expose large, rigid members such as rails and telescoping guides.

The barrier mounts to the door in a particularly uncomplicated way, which has the additional advantage over the large, cumbersome mountings of the prior art devices that it is readily removed from the doorway. This feature enables quick disconnection from the door, for passage by an adult therethrough. Little time must be expended in removing the barrier, and in replacing the same. Thus, in addition to being visually unobtrusive, the present invention is highly practical in its ease of removal from and replacement on its associated door for temporary passage.

The apparatus includes a spring loaded return mechanism around which the barrier winds. The barrier is a flexible web, such as a net or similar meshed fabric. This type of material reels quite compactly about the return mechanism. The return mechanism attaches firmly but, again, unobtrusively to the door jamb.

This construction provides instant deployment, in that the barrier is erected as quickly as the door can be opened. Retraction of the barrier is quickly and automatically performed, and further requires no effort or manipulation by the user. It is merely sufficient to close the door.

Several advantages accrue from employing a flexible web. One advantage is that there is no rigid member which could snag, pinch, cut, trap, or attract a child or pet. This holds true both when extended for deployment and when the barrier is retracted.

A second advantage is that it discourages climbing by both pets and children. Unlike rigid members, the sag that inevitably occurs when the net is grasped and weight imposed thereon does not provide a confident feel. It may fail to support a climber to the extent that the climber is lowered back to the floor. The spring loading will restore the web to its original position when the weight is relieved.

Still another advantage lies in the fact that the flexible web remains taut under spring tension. This avoids collapse when the door is open, and assures compact storage when the barrier is stored.

Accordingly, it is a principal object of the invention to provide a barrier which obstructs passage through a doorway when the door is opened.

It is another object of the invention to cause the barrier to expand or pay out responsive to progressive opening of the door, so that the barrier tautly spans space between the door and its jamb regardless of how widely the door is opened.

It is a further object of the invention to be as unobtrusive as is feasible.

It is again an object of the invention to deploy and retract instantly.

Still another object of the invention is to discourage climbing of the barrier.

Yet a further object of the invention is to eliminate sharp or rigid protrusions from the barrier.

An additional object of the invention is to enable expedient removal from the door, so as to enable passage through the door, and to enable expedient replacement thereon.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
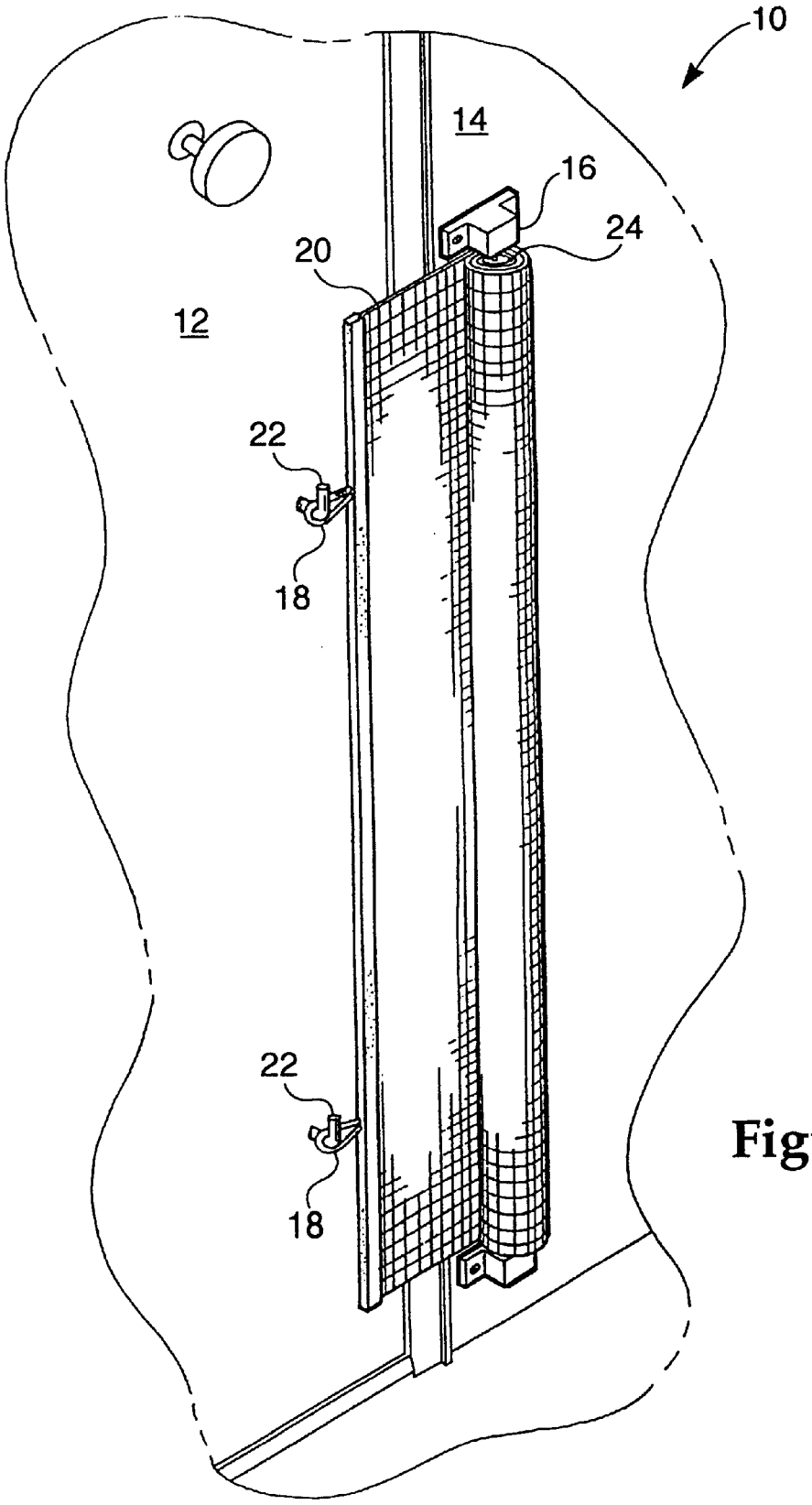
FIG. 1 is an environmental perspective view of the novel barrier, showing a door in the closed position.
Figure 2:
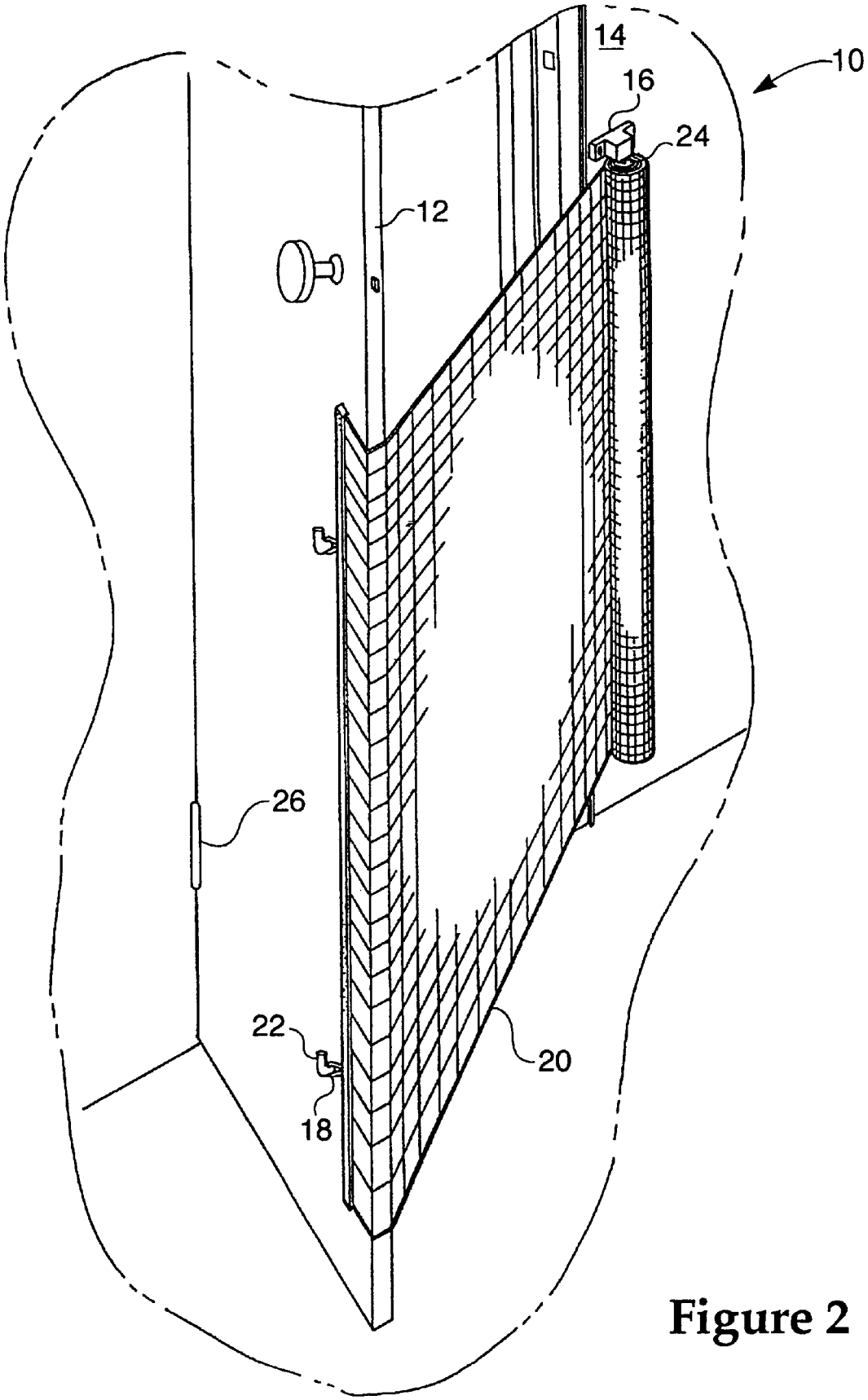
FIG. 2 is an environmental perspective view of the novel barrier, showing the door substantially open.

Turning now to FIG. 1 of the drawings, novel doorway barrier 10 is seen attached to a door 12 and an associated door frame or door jamb 14. The door 12 is mounted to the door frame 14 by hinges 26 (one of which is seen in FIG. 2), only one of which is seen. Barrier 10 is solidly fastened to frame or jamb 14, opposite from the hinges as by pillow blocks 16. Attachment at door 12 is accomplished by slipping loop 18 secured to web 20 over hook 22 driven or screwed into door 12.

Barrier 10 comprises a reel for storing and paying out web 20, and a spring loaded return mechanism for automatically rewinding the reel when door 12 is closed. A mechanical return device 24 as employed in a window shade includes the reel and return mechanism, and is thus suitable for incorporation into barrier 10.

Web 20 comprises a net or similar material of open construction or mesh, and of suitable strength. The material must be strong enough not to tear when restraining a child or pet attempting unauthorized passage through the doorway, so that it will also withstand efforts at climbing by children or large pets (neither shown). The mesh may be of any suitable fineness so that it prevents passage of objects, passes air currents and light, and has the requisite strength. Passing of air currents and light, so that people can see through it, will satisfy the curiosity of small children who might otherwise be tempted to circumvent barrier 10.

A preferred maximum opening dimension of the holes of the mesh is one inch (2.5 cm), as this dimension will generally prevent hands, feet, and the head of a child from being caught in the web.

Web 20 is attached permanently to return device 24, so that it is stored on and paid out from the reel therein. Loop 18 is secured to the other end of web 20, and engage hook 22. Attachment of loop 18 on hook 22 by a person, and therefore of web 20 to door 12, is thus manually removable.

FIG. 2 shows the invention with web 20 extended responsive to opening of door 12. A person can unhook web 20 from hook 22 from either side of the door when the door is open, and from the same side as hook 22 even when the door is closed.

The present invention may also be practiced in other settings notably sliding doors and doors of wheeled vehicles (not shown) Although the specific configuration of the door and its jamb will vary, the same principles set forth above are applied. The reel may be fastened to either one of the door and the jamb.

A doorway protected from unintended passage therethrough of children and pets, but which provides immediate deployment, ready removal by an adult, and unobtrusive storage when not extended to close the doorway, is hereby shown.

It is to be understood that the present invention is not limited to the sole embodiment described above, but encompasses any and all embodiments within the scope of the following claims.

I claim:

1. An extensible doorway barrier for deterring passage through an opening of a door, the door mounted to a door frame, said barrier comprising:

flexible material means for spanning a lower portion of the otherwise unobstructed opening of said door to provide a visual barrier deterring egress of pets or small children while leaving an upper portion of the opening unobstructed, said flexible material means yielding downwardly in response to weight of a child or pet attempting to climb the flexible material means;

a reel attached to a proximal end of said flexible material means for storing said flexible material means and paying out said flexible material means as the door is opened, said reel adapted for attachment to one of said door frame and said door on a side thereof proximate to the door opening;

rewinding means associated with said reel for maintaining tension in said flexible material means during opening of the door, for facilitating said yielding downwardly in response to weight of said flexible material means, and for automatically rewinding said flexible material means onto said reel as the door is closed; and attachment means connected to a distal end of said flexible material means and adapted for connection to at least one attachment point on the other of the door frame and the door, proximate to the door opening, for permitting manual attachment of said distal end to, and removal of said distal end from, said attachment point.

2. The extensible doorway barrier of claim 1 wherein said attachment means comprises at least one loop secured to said flexible material means and adapted for engagement with a hook secured to the attachment point.

3. The extensible doorway barrier of claim 1 wherein said flexible material means is an open mesh net.

4. The extensible doorway barrier of claim 1 wherein said attachment means permits ready detachment of said distal end from the attachment point from either side of the flexible material means when said flexible material means is spanning the door opening.

5. A door swingably mounted to a door frame by hinges in combination with an extensible doorway barrier for deterring passage through an opening between the door and the door frame, said barrier comprising:

flexible material means for spanning a lower portion of the otherwise unobstructed opening of said door to provide a visual barrier deterring egress of pets or small children while leaving an upper portion of the opening unobstructed;

a reel attached to a proximal end of said flexible material means for storing said flexible material means and paying out said flexible material means as the door is opened, said reel adapted for attachment to one of said door frame and said door on a side thereof proximate to the door opening;

rewinding means associated with said reel for maintaining tension in said flexible material means during opening of the door and for automatically rewinding said flexible material means onto said reel as the door is closed; and attachment means connected to a distal end of said flexible material means and adapted for connection to at least one attachment point on the other of the door frame and the door, proximate to the door opening, for permitting manual attachment of said distal end to, and removal of said distal end from, said attachment point.

6. The combination of claim 5 wherein said flexible material means yields downwardly in response to weight of a child or pet attempting to climb the flexible material means.

7. The combination of claim 5 wherein the door has an interior surface and an edge opposite the hinges, and said attachment means is located on the interior surface of the door, proximate the door edge, such that when said door swings open, said flexible material means overlaps said door edge and is pulled by said door.

8. The combination of claim 5 wherein said flexible material means is an open mesh net.

9. The combination of claim 5 wherein said attachment means permits ready detachment of said distal end from the attachment point from both inside and outside the door when the door is open.

10. The combination of claim 5 wherein said flexible material means leaves the upper portion of the opening unobstructed to readily permit deliveries through the upper portion of the opening.

11. A door mounted to move relative to a door frame to provide an opening between said door and said door frame, in combination with an extensible doorway barrier for deterring passage through the opening, said barrier comprising:

flexible material means for spanning a lower portion of the otherwise unobstructed opening of said door to provide a visual barrier deterring egress of pets or small children while leaving an upper portion of the opening unobstructed;

a reel attached to a proximal end of said flexible material means for storing said flexible material means and paying out said flexible material means as the door is opened, said reel adapted for attachment to one of said door frame and said door on a side thereof proximate to the door opening;

rewinding means associated with said reel for maintaining tension in said flexible material means during opening of the door and for automatically rewinding said flexible material means onto said reel as the door is closed; and attachment means connected to a distal end of said flexible material means and adapted for connection to at least one attachment point on the other of the door frame and the door, proximate to the door opening, for permitting manual attachment of said distal end to, and removal of said distal end from, said attachment point.

12. The combination of claim 11 wherein said attachment means comprises at least one loop secured to said flexible material means, and a hook secured to the attachment point, said loop engageable with said hook.

13. The combination of claim 11 wherein said flexible material means yields downwardly in response to weight of a child or pet attempting to climb the flexible material means.

14. The combination of claim 11 wherein said flexible material means is an open mesh net.

15. The combination of claim 11 wherein said attachment means permits ready detachment of said distal end from the attachment point from both inside and outside the door when the door is open.

16. The combination of claim 11 wherein said flexible material means leaves the upper portion of the opening unobstructed to readily permit deliveries through the upper portion of the opening.

* * * * *